US011261762B2

(12) United States Patent
Dale et al.

(10) Patent No.: US 11,261,762 B2
(45) Date of Patent: Mar. 1, 2022

(54) IMPROVING STEAM POWER PLANT EFFICIENCY WITH NOVEL STEAM CYCLE TREATMENTS

(71) Applicant: BL Technologies, Inc., Minnetonka, MN (US)

(72) Inventors: Trevor James Dale, Trevose, PA (US); Gregory J. Robinson, Trevose, PA (US); James Robinson, Trevose, PA (US); Anthony M. Rossi, Trevose, PA (US); Robert Trossbach, Trevose, PA (US)

(73) Assignee: BL Technologies, Inc., Minnetonka, MN (US)

( * ) Notice: Subject to any disclaimer, the term of this patent is extended or adjusted under 35 U.S.C. 154(b) by 0 days.

(21) Appl. No.: 16/763,362

(22) PCT Filed: Oct. 19, 2018

(86) PCT No.: PCT/US2018/056611
§ 371 (c)(1),
(2) Date: May 12, 2020

(87) PCT Pub. No.: WO2019/103799
PCT Pub. Date: May 31, 2019

(65) Prior Publication Data

US 2020/0291825 A1 Sep. 17, 2020

Related U.S. Application Data

(60) Provisional application No. 62/589,101, filed on Nov. 21, 2017.

(51) Int. Cl.

| | |
|---|---|
| ***F01K 19/00*** | (2006.01) |
| ***F01K 13/00*** | (2006.01) |
| ***F28B 1/02*** | (2006.01) |

(52) U.S. Cl.
CPC ..... *F01K 19/00* (2013.01); *F01K 13/006* (2013.01); *F28B 1/02* (2013.01)

(58) Field of Classification Search
CPC ..... F01K 19/00; F01K 13/006; F28B 1/02
See application file for complete search history.

(56) References Cited

U.S. PATENT DOCUMENTS 4,112,202 A * 9/1978 Hug ..... H01M 6/10 429/94
4,270,357 A * 6/1981 Rossi ..... F01K 7/345 60/660

(Continued)

FOREIGN PATENT DOCUMENTS

DE 10056241 A1 5/2002
EP 1925782 A1 5/2008

(Continued)

OTHER PUBLICATIONS

International Search Report and Written Opinion issued in related International Application No. PCT/US2018/056611 dated Feb. 11, 2019; 14 pages.

*Primary Examiner* — Shafiq Mian
(74) *Attorney, Agent, or Firm* — Armstrong Teasdale LLP

(57) ABSTRACT

A process for improving the efficiency of a steam power generation plant, the process providing utilizing steam or water from a steam cycle of a steam power plant; and supplying a steam cycle treatment to the steam cycle, thereby generating a hydrophobic coating within the steam cycle.

20 Claims, 1 Drawing Sheet

(56) References Cited

U.S. PATENT DOCUMENTS

| | | | | |
|---|---|---|---|---|
| 8,580,351 | B2 | 11/2013 | Haje et al. | |
| 9,103,232 | B1 * | 8/2015 | Hall | F28F 13/187 |
| 9,588,090 | B2 * | 3/2017 | Lendi | G01N 21/78 |
| 2002/0098083 | A1 * | 7/2002 | Blangetti | C23C 8/36 415/200 |
| 2003/0015475 | A1 * | 1/2003 | Liebig | F01K 21/06 210/698 |
| 2010/0224638 | A1 * | 9/2010 | Rubner | F22B 37/04 220/660 |
| 2011/0094227 | A1 * | 4/2011 | Ast | F01K 23/065 60/671 |
| 2012/0193093 | A1 * | 8/2012 | James | E04H 5/02 166/267 |
| 2016/0160354 | A1 * | 6/2016 | Widmer | C23C 18/1662 427/437 |
| 2017/0268383 | A1 * | 9/2017 | Hirayama | F01K 11/02 |
| 2018/0322969 | A1 * | 11/2018 | Stellwag | G21D 1/04 |
| 2019/0059418 | A1 * | 2/2019 | DiMarzio | A23L 2/68 |

FOREIGN PATENT DOCUMENTS

| | | | |
|---|---|---|---|
| EP | 2746428 | A1 | 6/2014 |
| WO | 03044374 | A1 | 5/2003 |
| WO | 20100093679 | A2 | 8/2010 |

* cited by examiner

IMPROVING STEAM POWER PLANT EFFICIENCY WITH NOVEL STEAM CYCLE TREATMENTS

CROSS-REFERENCE TO RELATED APPLICATION

This application is a national phase of International Patent Application No. PCT/US2018/056611 filed Oct. 19, 2018, which claims priority to U.S. Provisional Patent Application Ser. No. 62/589,101 filed Nov. 21, 2017, the entireties of which are herein incorporated by reference.

BACKGROUND OF THE INVENTION

Field of Invention

The present invention relates to methods and compositions for improving steam power plant efficiency, and more particularly, to improving steam power plant efficiency through the use of novel steam cycle additives or treatment.

Description of Related Art

In steam generating systems, such as power plants, condensers are used to convert steam from a gas to a liquid, after it has passed through a steam turbine. Different forms of condensers are used where the heat from the condensing steam is rejected to a gas, as in an air cooled condenser (ACC), or to a liquid, as in a water cooled condenser (WCC). In a WCC, the condenser comprises a large number of condenser tubes through which the water passes and the steam is condensed on the outside of the tubes or shell side of the condenser. Film-wise condensation conventionally takes place on the condenser tubes that are filled with a cooling working fluid, so the liquid steam transforms into a liquid aggregation state. This formed liquid film however, acts as a barrier to additional heat rejection to the cooling working fluid and results in a decrease in the overall efficiency of the condensation process.

It has been previously demonstrated that providing a hydrophobic or low surface energy coating to the condenser in a steam power plant will decrease the heat transfer resistance of the condensation process. The hydrophobically coated condenser tubes provide a purposeful transition from film-wise condensation to drop-wise condensation, which is a more efficient heat transfer condensation method. Drop-wise condensation does not suffer from the creation of an insulating liquid film on the steam side of the condenser. Simplistically, the drops formed on a hydrophobic surface run off the tube rather than forming the water film and free up the condenser surface to condense more steam. Unfortunately, creation of this surface to date requires costly manufacturing of the condenser tubes to create such a coating prior to installation of the condenser in the plant, or taking the steam plant off-line to retrofit it. This method also suffers from rapid degradation of the coating under operational conditions, thus rendering it ineffective for long-term improvements in efficiency.

In addition to efficiency losses in the condensation process, power plant efficiency can be decreased through "wetness losses" in steam turbine efficiency, a phenomenon that occurs in steam turbines once condensation from dry steam to wet steam has occurred. Wet steam flow in steam turbines leads to degraded efficiency and blade erosion in the turbine stages. Quantification of the wetness losses in efficiency in the steam turbine is often simplified to the "Baumann Rule,"

which states that there is a 1% efficiency loss for every 1% wetness fraction in the steam.

There are multiple loss mechanisms associated with wet steam. The extent of losses depends primarily on the size of the water droplets formed within the steam turbine. In most cases, only small droplets, in the range of micrometers, are contained in the steam phase. The water droplets maintain their size and do not coalesce into larger droplets as long as they keep floating or flowing with the steam. Similar to a vapor, they flow along with the steam path that exerts the impulse onto the turbine blades. As long as the droplets remain small enough to follow the flow path, their impact on steam turbine efficiency is minimized. However, as they flow through the stationary and rotating blades, the droplets grow. During the contact with metal surfaces, probably in particular with the concave metal surfaces of the stationary blades, the small condensate droplets spread on the surface and form a condensate film that flows on the blades over the concave or convex surfaces subject to the effect of the shearing forces of the steam. At the trailing edge of the blade, the fluid film leaves the surface and is accelerated and divided by the rotating blades. The droplets generated by this division have a larger diameter than the droplets created by spontaneous condensation. Large droplets leave the flow path of the steam and impact the downstream blades causing momentum losses to the turbine.

By centrifugal forces, these larger droplets are spun outward by the rotating blades in the direction towards the turbine housing. This means that a part of the impulse of the working medium is not transferred onto the blades, thus resulting in a moisture loss that reduces the degree of efficiency of the low-pressure turbine. This phenomenon is even stronger the more that the size and mass of the droplets, as well as the centrifugal force, increase. Furthermore, accumulations of water at the inside surfaces of the housing of the low-pressure turbine result in dissipative friction losses on the rotating blade tips and blade shrouds.

It has been previously demonstrated that providing a hydrophobic coating to the steam turbine components can increase the efficiency of the steam turbine. For example, low-pressure turbines stationary and rotating blades with a low surface energy hydrophobic or water-repellant coating. The hydrophobic property of the coating has the result that small droplets contained in the steam phase, upon impacting a coated blade, roll off across the blade in the form of smaller droplets more likely to follow the steam path than larger droplets, thus preventing moisture losses and increasing the efficiency of the turbine. However, the challenge has been in the manufacturing and application of the film/coating, as previous applications of such coatings involve manufacturing the steam turbine components with an additional coating or taking the steam power plant off-line to retrofit it. In addition to adding cost to the steam turbine, operational conditions have proven to destroy the properties of the coating, thus rendering it ineffective for long-term improvements in efficiency.

In addition to steam power plant condensers, industrial turbines can become output limited due to inadequate cooling capacity of the condenser (especially in the hottest months of the year) which increases turbine back pressure and thus increases the amount of condensate formed within the turbine itself. Thus another potential benefit to improving the heat transfer efficiency in the condenser would be to minimize this condensation within the turbine, thus minimizing wetness losses and mechanical degradation associated with wet steam flowing in the turbine.

Thus, it is desirable to provide methods and compositions that obviate and mitigate the shortcomings of the prior art, while successfully improving the steam plant efficiency through the use of novel steam cycle additives or treatment.

SUMMARY OF THE INVENTION

It was surprisingly discovered that by adding a steam cycle additive or treatment into the water or steam cycle generates a low surface energy coating on the steam turbine and condenser surfaces, which result in the increased efficiency in the overall system. The present invention increases steam plant efficiency by chemical injection of a steam cycle additive into an operating steam system.

In one embodiment, a process for improving the efficiency of a steam power generation plant is provided. The process comprises utilizing steam or water from a steam cycle of a steam power plant; and supplying a steam cycle treatment to the steam cycle, thereby generating a hydrophobic coating within the steam cycle.

In some embodiments, the steam cycle treatment comprises hydrophobic chemicals, amphiphilic chemicals, bolaamphiphilic chemicals, or mixtures thereof. In some embodiments, the steam cycle treatment is continuously supplied to the steam cycle by chemical injection. In some embodiments, the steam cycle treatment is introduced directly into the steam of the steam cycle. In some embodiments, the steam cycle treatment is introduced directly into the water of the steam cycle. In some embodiments, the steam power plant remains online during the addition of the steam cycle treatment.

In some embodiments, the hydrophobic coating is produced on either (i) a steam turbine, (ii) surfaces of a condenser, or (iii) both. In some embodiments, the hydrophobic coating includes amorphous carbon. In some embodiments, the amorphous carbon comprises hydrocarbon-containing carbon layers with up to about 10 to 50 at. % hydrogen content. In some embodiments, the hydrophobic coating includes a hydrophobic filler. In some embodiments, the hydrophobic filler is polysiloxane.

In yet another aspect, a steam cycle treatment is provided. The steam cycle treatment comprises an amphiphilic chemical containing a hydrophobic section and a hydrophilic section. In some embodiments, the hydrophobic section comprises a saturated or an unsaturated hydrocarbon, and the hydrophilic section comprises one or more groups selected from amines, ammoniums, acids, alcohols, ethers, phosphonates, phosphates, sulfonates, sulfates, or a combination thereof. In some embodiments, the hydrophobic section comprises a saturated or an unsaturated hydrocarbon, and the hydrophilic section comprises one or more amine or ammonium groups.

In some embodiments, the amphiphilic chemicals contain (1) a hydrophobic fluorinated saturated or unsaturated hydrocarbon section or (2) a hydrophobic silicon containing section, and (3) a hydrophilic section comprising one or more groups selected from amines, ammoniums, acids, alcohols, ethers, phosphonates, phosphates, sulfonates, sulfates, or a combination thereof. In some embodiments, the bolaamphiphilic chemicals contain a hydrophobic hydrocarbon section, and hydrophilic sections. In some embodiments, the hydrophobic section comprises a saturated or an unsaturated hydrocarbon. In some embodiments, the hydrophilic section comprises one or more groups selected from amines, ammoniums, acids, alcohols, ethers, phosphonates, phosphates, sulfonates, sulfates, or a combination thereof. In some embodiments, the hydrophobic section comprises a saturated hydrocarbon and the hydrophilic sections comprise one or more acid groups. In some embodiments, the bolaamphiphilic chemical contains (1) a hydrophobic fluorinated saturated or unsaturated hydrocarbon section or (2) a hydrophobic silicon containing section, and (3) hydrophilic sections. In some embodiments, the hydrophilic sections comprise one or more groups selected from amines, ammoniums, acids, alcohols, ethers, phosphonates, phosphates, sulfonates, sulfates, or a combination thereof.

In yet another embodiment, the steam cycle treatment comprises a mixture of an amphiphilic chemical and a bolaamphiphilic chemical. In some embodiments, the amphiphilic chemical contains a hydrophobic section consisting of a saturated or unsaturated hydrocarbon and the hydrophilic section contains one or more amine groups, and the bolaamphiphilic chemical contains a hydrophobic section consisting of a saturated or unsaturated hydrocarbon and the hydrophilic sections contain acid, amine, or ammonium groups.

In some embodiments, the steam cycle treatment additionally comprises dispersant chemicals, or mixtures thereof. In some embodiments, the steam cycle treatment additionally comprises ammonia, organic amines, phosphates, sodium hydroxide, or mixtures thereof to modify the pH within the steam cycle. In some embodiments, the steam cycle treatment additionally comprises hydrazine, carbohydrazide, hydroxylamines, quinones, ketoximes, or mixtures thereof to modify the oxidation-reduction potential within the steam cycle.

In some embodiments, the amphiphilic chemical is derived from a fatty acid with the hydrophilic section comprising one or more amine or ammonium groups. In some embodiments, the amphiphilic chemical is derived from a fatty acid with the hydrophilic section comprising one or more phosphate groups. In some embodiments, the amphiphilic chemical is derived from a fatty acid with the hydrophilic section comprising one or more amine or ammonium groups. In some embodiments, the amphiphilic chemical is derived from a fatty acid with the hydrophilic section comprising one or more phosphate groups.

DETAILED DESCRIPTION OF EXEMPLARY EMBODIMENTS

Figure 1:
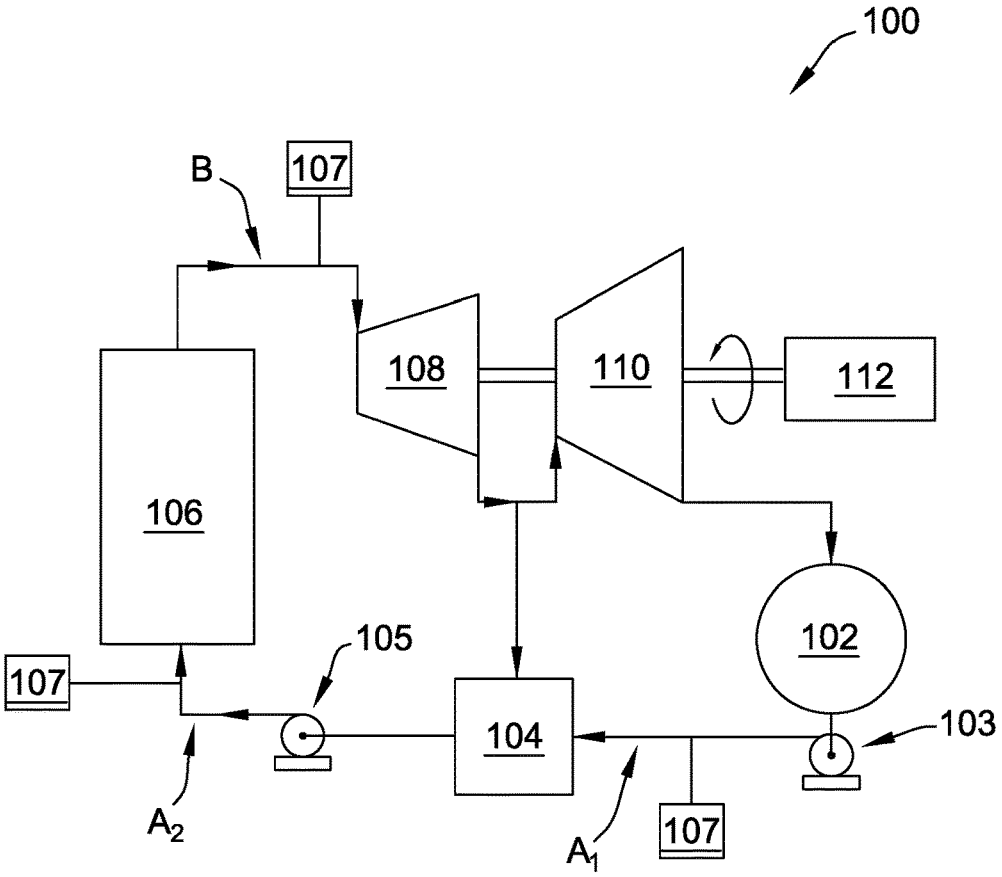
FIG. 1 is a schematic of a steam turbine power plant in accordance with an embodiment of the invention.

The invention will now be described in the following detailed description with reference to the drawing(s), wherein preferred embodiments are described in detail to enable practice of the invention. Although the invention is described with reference to these specific preferred embodiments, it will be understood that the invention is not limited to these preferred embodiments. But to the contrary, the invention includes numerous alternatives, modifications and equivalents as will become apparent from consideration of the following detailed description.

Approximating language, as used herein throughout the specification and claims, may be applied to modify any quantitative representation that could permissibly vary without resulting in a change in the basic function to which it is related. Accordingly, a value modified by a term or terms, such as "about", is not limited to the precise value specified. In at least some instances, the approximating language may correspond to the precision of an instrument for measuring the value. Range limitations may be combined and/or interchanged, and such ranges are identified and include all the sub-ranges included herein unless context or language indicates otherwise. Other than in the operating examples or where otherwise indicated, all numbers or expressions referring to quantities of ingredients, reaction conditions and the like, used in the specification and the claims, are to be understood as modified in all instances by the term "about".

"Optional" or "optionally" means that the subsequently described event or circumstance may or may not occur, or that the subsequently identified material may or may not be present, and that the description includes instances where the event or circumstance occurs or where the material is present, and instances where the event or circumstance does not occur or the material is not present.

As used herein, the terms "comprises," "comprising," "includes," "including," "has," "having" or any other variation thereof, are intended to cover a non-exclusive inclusion. For example, a process, method, article or apparatus that comprises a list of elements is not necessarily limited to only those elements, but may include other elements not expressly listed or inherent to such process, method article or apparatus.

The singular forms "a," "an" and "the" include plural referents unless the context clearly dictates otherwise.

FIG. 1 is a schematic illustration of an exemplary steam turbine power plant 100 as described in the present invention. The present invention provides a steam turbine power plant with increased efficiency from the use of novel steam cycle additives or treatment. The steam cycle treatment of the present invention modifies the system components such that less "wetness losses" occur in the steam turbine, and increase heat transfer that occurs across the steam condenser, thereby resulting in a gain in overall efficiency. Additionally, the present invention overcomes the previous challenges in the prior art by applying a film/coating continuously while the power plant is online through application of a steam cycle treatment.

With reference to FIG. 1, the steam turbine power plant 100 is provided. In some embodiments, the power plant 100 is a combined-cycle steam turbine power plant. In the illustrated embodiment, the steam turbine power plant 100 includes a condenser 102, a feed water heater 104, a boiler 106, a high pressure turbine 108, a lower pressure turbine 110, which may contain distinct temperature/pressure sections, and a generator 112. It should be understood by one skilled in the art that the steam turbine power plant 100 may alternatively include three pressure sections (not shown in the FIGURE), for example, a high pressure, an intermediate pressure, and low pressure section.

In the exemplary embodiment, the steam turbine power plant 100 includes a condenser 102. The condenser 102 receives steam that was used to turn a turbine which is then exhausted into the condenser 102. The steam is condensed as it comes in contact with cool tubes within the condenser 102, and the condensed steam is withdrawn from the bottom of the condenser 102. The condensed steam is commonly referred to as condensate water, or simply referred to herein as water. In some embodiments, the condenser 102 is a water cooled condenser, an air cooled condenser, a hybrid air, water cooled condenser, or the like.

In the exemplary embodiment, the water is subsequently pumped by a condensate pump 103 from the condenser 102 through a feedwater heater 104. The feedwater heater 104 includes heating equipment that raises the temperature of the water by utilizing extraction steam from various stages of the turbine. Preheating the feedwater reduces the irreversibility involved in steam generation and therefore improves the thermodynamic efficiency of the system. This reduces plant operating costs and also helps to avoid thermal shock to the boiler metal when the feedwater is introduced back into the steam cycle.

In the exemplary embodiment, the steam turbine power plant 100 includes a boiler 106. The water is pumped by a feedwater pump 105 from the feedwater heater 104 to the boiler 106. In some embodiments, the boiler 106 may be a solid fuel fired boiler, such as a coal fired boiler, a liquid fuel fired boiler, such as an oil fired boiler, a gas fired boiler, such as a natural gas fired boiler, a nuclear fission heated boiler, a heat recovery boiler, or mixture thereof. The water is pressurized and superheated in the boiler 106 to temperatures up to about 600° C. In some embodiments, as in the example of a geothermal plant, no boiler is necessary as they use naturally occurring steam sources.

In the exemplary embodiment, steam produced by the boiler 106 is fed to a high pressure turbine 108. Mechanical energy is created by the steam passing over a series of fixed and rotating blades within the high pressure turbine 108, wherein the fixed blades guide steam through the rotor blades, thereby causing the rotor to turn. The steam within the high pressure turbine 108 expands and cools as it moves through the blades.

In the exemplary embodiment, steam leaves the high pressure turbine 108 and is reheated in boiler 106 before moving to a lower pressure turbine 110. The lower pressure turbine 110 may contain multiple distinct turbine sections operating at different temperatures and pressures. In the lower pressure turbine 110, steam is further reduced in temperature and pressure. At this point, the steam within the lower pressure turbine 110 is no longer superheated and travels into the condenser 102, wherein the condenser 102 condenses the steam into water to be pumped back to the boiler 106.

In the exemplary embodiment, a generator 112 extracts power simultaneously from all sections of the steam turbine.

The present invention provides a process for improving the efficiency of a steam power generation plant. The process utilizes steam or water from a steam cycle of a steam power plant, and supplies a steam cycle treatment. By adding the steam cycle treatment to the steam cycle, a hydrophobic coating is generated within the steam cycle.

Figure 2:
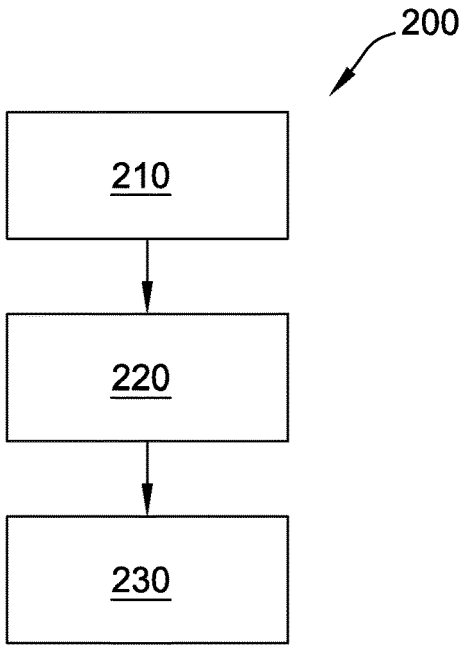
FIG. 2 is a process flow chart showing an exemplary process for improving the efficiency of a steam power generation plant.

FIG. 2 is a process flow chart showing an exemplary process 200 for improving the efficiency of a steam power generation plant, as described in the present disclosure. With reference to FIG. 2, process step 210 shows utilizing steam or water from a steam cycle of a steam power plant. Process step 220 shows supplying a steam cycle treatment to the steam cycle. In one embodiment, the steam cycle treatment may be supplied to the steam cycle continuously. The steam cycle treatment may be hydrophobic chemicals, amphiphilic chemicals, bolaamphiphilic chemicals, or mixtures thereof. In step 230, the steam cycle treatment generates a hydrophobic coating within the steam cycle.

A. Steam Cycle Additives/Treatment

The steam cycle treatment is added into the water or steam system that travels with the steam, to create the hydrophobic coating or film on the steam turbine and surfaces of the condenser 102.

In other embodiments, the steam cycle treatment is introduced directly into the steam or water of the steam cycle. By adding the steam cycle additives or treatment directly to the water or steam system, the additives can be applied continuously to the steam cycle during operation to form and maintain the hydrophobic coating or film. In turn, this removes the need to modify the components during manufacturing and pre-operation, and further overcomes degradation of the hydrophobic coating over time as the hydrophobic coating or film may be regenerated with time. In some embodiments, the steam power plant remains online during the addition of the steam cycle treatment.

It should be understood that the term "continuously" refers to the generation and maintenance of the hydrophobic coating. This may include application of the steam cycle treatment to the steam cycle less than 100% of the operation time. Because the hydrophobic coating is generated in-situ, in some embodiments, the steam cycle treatment is not continuously applied 100% of the operation time.

In reference to FIG. 1, the steam cycle additives may be provided to a steam cycle. In some embodiments, the steam cycle additives may be added directly to the water at $A_1$ before it is pumped to the feedwater heater 104. In other embodiments, the steam cycle additives may be added to the water at $A_2$ before it is pumped to boiler 106. In other embodiments, the steam cycle additives are added to both the water at $A_1$ and at $A_2$. In other embodiments, the steam cycle additives of the present invention may be added directly to the steam at B subsequent to leaving the boiler 106.

In some embodiments, the steam cycle additives or treatment of the present invention may be added to either the water or to the steam, or both, by conventional methods. In a preferred embodiment, the steam cycle treatment is added by chemical injection methods 107.

The steam cycle treatment of the present invention comprises amphiphilic chemicals or bolaamphiphilic chemicals, both comprising a hydrophobic section. In some embodiments, the hydrophobic section comprises a saturated or an unsaturated hydrocarbon. In some embodiments, the hydrophobic sections can be made up of silicon containing molecules, fluorinated molecules, saturated and unsaturated hydrocarbon molecules, or the like.

The steam cycle treatment of the present invention comprises amphiphilic chemicals or bolaamphiphilic chemicals, both comprising a hydrophilic section. In some embodiments, the hydrophilic section comprises carbon containing groups such as, but not limited to, carboxylates, alcohols and ethers. In some embodiments, the hydrophilic section comprises sulfur containing groups such as, but not limited to, sulfates and sulfonates. In some embodiments, the hydrophilic section comprises nitrogen containing groups such as, but not limited to, amines or ammoniums. In some embodiments, the hydrophilic section comprises phosphorus containing groups such as, but not limited to, phosphates and phosphonates, or the like.

In some embodiments, the amphiphilic chemicals contain (1) a hydrophobic fluorinated saturated or unsaturated hydrocarbon section or (2) a hydrophobic silicon containing section, and (3) a hydrophilic section comprising a single amine, multiple amines, an acid, phosphates, sulfates, or a combination thereof.

In some embodiments, the bolaamphiphilic chemicals include compounds containing hydrophilic sections at both ends of the molecule connected by hydrophobic sections. In some embodiments, the bolaamphiphilic chemical contains (1) a hydrophobic fluorinated saturated or unsaturated hydrocarbon section or (2) a hydrophobic silicon containing section, and (3) a hydrophilic section.

B. Hydrophobic Coating

By adding the steam cycle treatment to the steam cycle, a hydrophobic coating is generated. The term "hydrophobic" or "hydrophobic coating" can be taken to mean a low surface energy surface, which is water-repellant or on which dropwise condensation can take place. Furthermore, the term "hydrophobic coating" can hereinafter also be taken to mean a coating which has a hydrophobic effect, sometimes described as the lotus effect, i.e. which has a water-repelling effect.

The hydrophobic coating of the present invention decreases the wetness losses associated with some of the key loss mechanisms in a steam turbine. Wetness losses in efficiency occur in the steam turbine once the transition begins from dry steam to wet steam. In some embodiments, the hydrophobic coating of the present invention decreases these wetness losses associated with drag or friction, braking or momentum and centrifugal forces within the steam turbine.

The present invention includes applying or manufacturing a hydrophobic coating or film to the steam turbine and condenser through the steam cycle treatment while the power plant remains online. In some embodiments, the hydrophobic coating may be generated on the steam turbine, the surfaces of the condenser 102, or both the steam turbine and the surfaces of the condenser 102, resulting in the increased efficiency in the overall steam system.

In some embodiments, the hydrophobic coating generated with the steam cycle treatment contains hydrophobic chemicals. Such hydrophobic chemicals include silicon based compounds, fluorinated compounds, or the like.

In some embodiments, the hydrophobic coating contains amphiphilic chemicals. These include compounds containing both hydrophobic and hydrophilic sections. The hydrophobic sections can be made up of silicon containing molecules, fluorinated molecules, saturated and unsaturated hydrocarbon molecules, or the like. The hydrophilic section can be made up of carbon containing groups such as, but not limited to, carboxylates, alcohols and ethers, sulfur containing groups such as, but not limited to, sulfates and sulfonates, nitrogen containing groups such as, but not limited to, amines or ammoniums, and phosphorus containing groups such as, but not limited to, phosphates and phosphonates, or the like.

In some embodiments, the hydrophobic coating contains bolaamphiphilic chemicals. These include compounds containing hydrophilic sections at both ends of the molecule connected by hydrophobic sections. The hydrophobic sections can be made up of silicon containing molecules, fluorinated molecules, saturated and unsaturated hydrocarbon molecules, or the like. The hydrophilic section can be made up of carbon containing groups such as, but not limited to, carboxylates, alcohols and ethers, sulfur containing groups such as, but not limited to, sulfates and sulfonates, nitrogen containing groups such as, but not limited to, amines or ammoniums, and phosphorus containing groups such as, but not limited to, phosphates and phosphonates, or the like.

In some embodiments, the hydrophobic coating contains amorphous carbon. The term "amorphous carbon" as used herein includes hydrocarbon-containing carbon layers with up to 10 to 50 at. % hydrogen content and a ratio of $sp^3$ to $sp^2$ bonds between 0.1 and 0.9. Under certain conditions, amorphous carbon has a low surface energy in comparison to the surface tension of water, so that a hydrophobic or water-repelling property is achieved.

In some embodiments, the hydrophobic coating contains hydrophobic filler. In some embodiments, the hydrophobic filler is polysiloxane. The hydrophobic coating containing a hydrophobic filler includes properties that can be adjusted to withstand the working temperature and can achieve the required temperature resistance/hydrophobicity balance. For example, embodiments of a hydrophobic filler may exclusively comprise polysiloxane particles, or where polysiloxane particles may be used in combination with other hydrophobic particles.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A process for improving the efficiency of a steam power generation plant, the process comprising:

utilizing steam or water from a steam cycle of a steam power plant; and supplying a steam cycle treatment to the steam cycle, wherein the steam cycle treatment is continuously supplied to the steam cycle thereby generating a hydrophobic coating within the steam cycle, wherein the steam cycle treatment comprises amphiphilic chemicals containing a hydrophobic section and a hydrophilic section, bolaamphiphilic chemicals, or mixtures thereof, wherein the hydrophobic section comprises a saturated or unsaturated hydrocarbon, a hydrophobic fluorinated saturated or unsaturated hydrocarbon section, or a hydrophobic silicon containing section; and the hydrophilic section comprises one or more groups selected from amines, ammoniums, acids, alcohols, ethers, phosphonates, phosphates, sulfonates, sulfates, or a combination thereof.

2. The process as in claim 1, wherein the steam cycle treatment is (1) continuously supplied to the steam cycle by chemical injection, (2) introduced directly into the steam of the steam cycle, or (3) introduced directly into the water of the steam cycle.

3. The process as in claim 1, wherein the steam cycle treatment is carried out during operation of the steam power generation plant.

4. The process as in claim 1, wherein the hydrophobic coating is produced on either (i) a steam turbine, (ii) surfaces of a condenser, or (iii) both.

5. The process as in claim 1, wherein the hydrophobic coating includes amorphous carbon.

6. The process as in claim 1, wherein the hydrophobic coating includes a hydrophobic filler.

7. The steam cycle treatment as in claim 1, wherein the hydrophobic section comprises a saturated or an unsaturated hydrocarbon.

8. The steam cycle treatment as in claim 1, wherein the hydrophobic section comprises a saturated or an unsaturated hydrocarbon, and the hydrophilic section comprises one or more amine or ammonium groups.

9. The steam cycle treatment as in claim 1, wherein the bolaamphiphilic chemicals contain a hydrophobic hydrocarbon section, and hydrophilic sections.

10. The steam cycle treatment as in claim 9, wherein the hydrophobic section comprises a saturated or an unsaturated hydrocarbon.

11. The steam cycle treatment as in claim 9, wherein the hydrophilic section comprises one or more groups selected from amines, ammoniums, acids, alcohols, ethers, phosphonates, phosphates, sulfonates, sulfates, or a combination thereof.

12. The steam cycle treatment as in claim 9, wherein the hydrophobic section comprises a saturated hydrocarbon and the hydrophilic sections comprise one or more acid groups.

13. The steam cycle treatment as in claim 1, wherein the bolaamphiphilic chemical contains (1) a hydrophobic fluorinated saturated or unsaturated hydrocarbon section or (2) a hydrophobic silicon containing section, and (3) hydrophilic sections.

14. The steam cycle treatment as in claim 13, wherein the hydrophilic sections comprise one or more groups selected from amines, ammoniums, acids, alcohols, ethers, phosphonates, phosphates, sulfonates, sulfates, or a combination thereof.

15. The steam cycle treatment as in claim 1, wherein the steam cycle treatment comprises a mixture of an amphiphilic chemical and a bolaamphiphilic chemical.

16. The steam cycle treatment as in claim 15, wherein the amphiphilic chemical contains a hydrophobic section consisting of a saturated or unsaturated hydrocarbon and the hydrophilic section contains one or more amine groups, and the bolaamphiphilic chemical contains a hydrophobic section consisting of a saturated or unsaturated hydrocarbon and the hydrophilic sections contain acid, amine, or ammonium groups.

17. The steam cycle treatment as in claim 1, wherein the steam cycle treatment additionally comprises dispersant chemicals, or mixtures thereof.

18. The steam cycle treatment as in claim 17, wherein the steam cycle treatment additionally comprises ammonia, organic amines, phosphates, sodium hydroxide, or mixtures thereof to modify the pH within the steam cycle.

19. The steam cycle treatment as in claim 17, wherein the steam cycle treatment additionally comprises hydrazine, carbohydrazide, hydroxylamines, quinones, ketoximes, or mixtures thereof to modify the oxidation-reduction potential within the steam cycle.

20. The steam cycle treatment as in claim 1, wherein the amphiphilic chemical is (1) derived from a fatty acid with the hydrophilic section comprising one or more amine or ammonium groups, or (2) derived from a fatty acid with the hydrophilic section comprising one or more phosphate groups.

* * * * *